United States Patent [19]

Valois

[11] 4,368,854

[45] Jan. 18, 1983

[54] YARN FEEDER MOTOR CONTROL

[75] Inventor: Rene J. Valois, Woonsocket, R.I.

[73] Assignee: Leesona Corporation, Warwick, R.I.

[21] Appl. No.: 344,195

[22] Filed: Jan. 29, 1982

[51] Int. Cl.[3] ..... B65H 51/20

[52] U.S. Cl. ..... 242/47.01; 139/452

[58] Field of Search ..... 242/47.01, 47.04, 47.05, 242/47.06, 47.07, 47.08, 47.09, 47.1, 47.11, 47.12, 47.13, 47, 45; 139/452; 66/132 R

[56] References Cited

U.S. PATENT DOCUMENTS

| | | | |
|---|---|---|---|
| 3,776,480 | 12/1973 | Lawson | 242/47.01 |
| 4,132,368 | 1/1979 | Schiess et al. | 242/47.01 |
| 4,226,379 | 10/1980 | Brouwer et al. | 242/47.01 |
| 4,298,172 | 11/1981 | Hellstrom | 242/47.01 |

*Primary Examiner*—Stanley N. Gilreath
*Attorney, Agent, or Firm*—Burnett W. Norton

[57] ABSTRACT

In a yarn storage feeder system of the type disclosed in U.S. Pat. No. 4,226,379 and having a yarn storage unit upon which a quantity of yarn is maintained from a yarn supply for intermittent withdrawal and delivery to yarn feeding and/or consuming means, such as a loom, and in which the yarn storage unit is driven by a low inductance DC motor such as a flat armature or pancake DC motor powered by a full wave rectified AC current, a significant improvement in motor operating efficiency, especially output torque, is achieved by incorporating an electrical choke in the circuit supplying such current to the DC motor. In the operation of the system the output speed of the motor is monitored and the current flow to the motor is controlled to maintain a preset reference speed by an SCR phase control unit, preferably through a transistor included in the motor circuit and having its base biased by the output of the SCR unit in synchronism with the frequency of the rectified AC current for a fraction of the duration of the current pulses, the extent of the fraction being adjusted to maintain the motor output speed at the reference level. The quantity of collected yarn can also be monitored and the speed control unit momentarily deactivated if that quantity exceeds a predetermined amount.

9 Claims, 6 Drawing Figures

FIG. 1
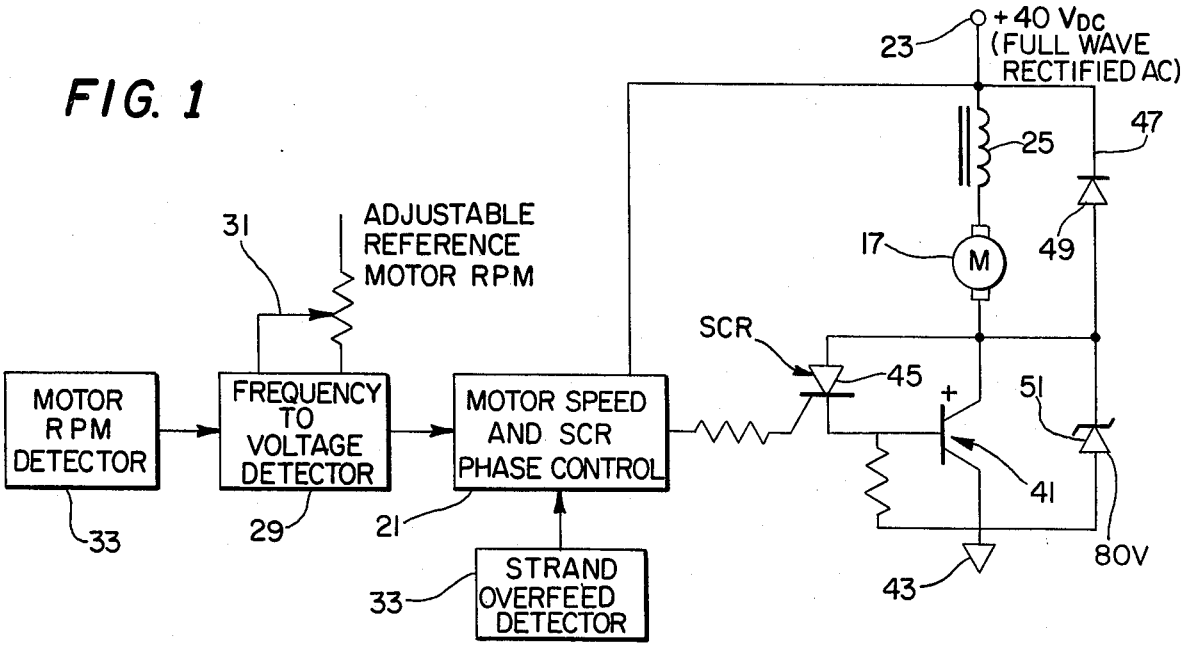
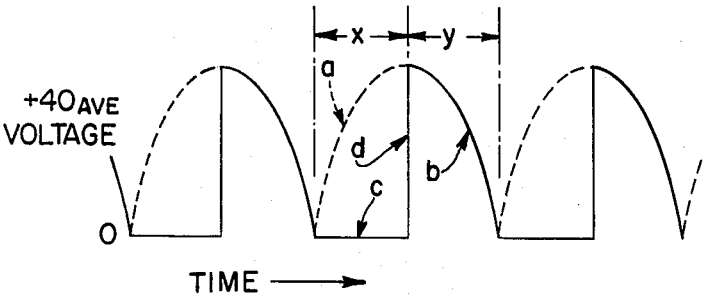
FIG. 2
FIG. 3
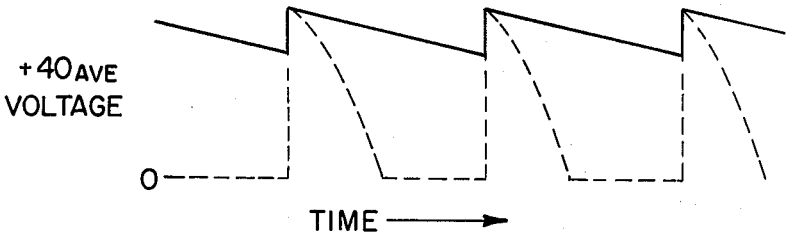
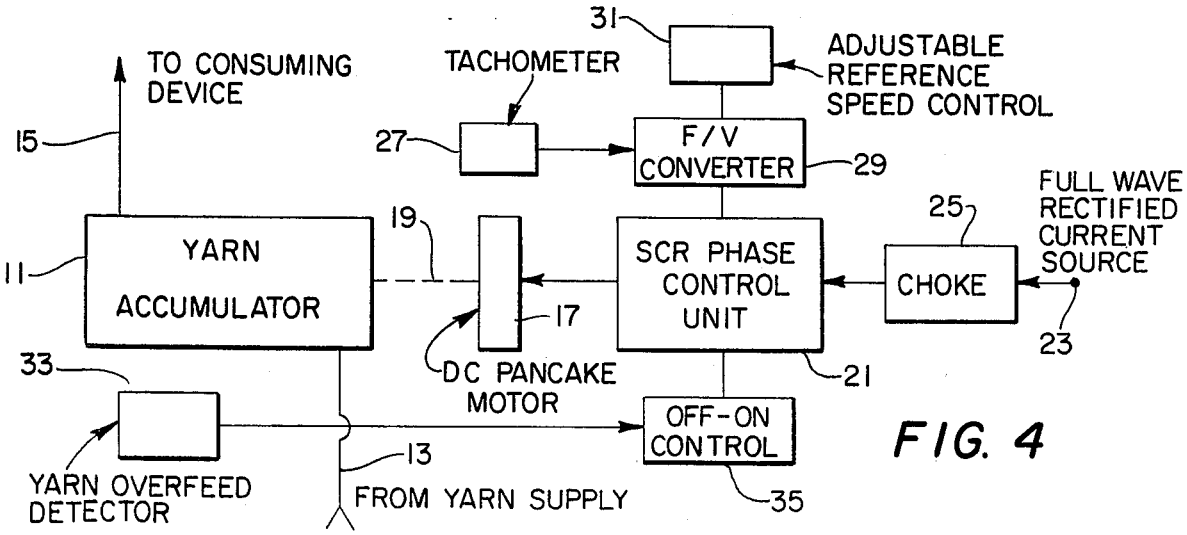
FIG. 4

YARN FEEDER MOTOR CONTROL

BACKGROUND OF THE INVENTION (a) Field of the Invention

This invention relates to a yarn storing and feeding system adapted to collect or accumulate a given quantity of yarn supplied from a yarn source for delivery to an intermittently operating yarn or consuming device and to replenish the withdrawn yarn so as to maintain the accumulated quantity at a generally constant level, and is an improvement upon the yarn storage feeder system disclosed in U.S. Pat. No. 4,226,379.

(b) Discussion of the Prior Art

As is explained more fully in U.S. Pat. No. 4,226,379 it has been known in the textile art to interpose between an intermittently operating consuming unit, especially one involving high speed delivery of the yarn thereby and a yarn supply source, a yarn accumulating or storage system capable of creating and maintaining a body of yarn for ready and immediate delivery therefrom to the yarn consuming unit, the body of yarn being repleinished as lengths thereof are withdrawn by the latter unit. An early example of this type of yarn storage and feeding system is that disclosed in U.S. Pat. No. 3,776,480 issued to John B. Lawson on Dec. 4, 1973, the disclosure of which is incorporated by reference herein as representing the general system forming the context for the present improvement and describing significant details of construction and operation of that system which are not directly germane to the present improvement. In the Lawson storage-feeder unit, the yarn is accumulated upon a generally cylindrical structure, referred to as a "drum" although it may consist of peripherally spaced segments which define a drum-like contour. The drum is associated with a hollow yarn feeder tube of generally crank-shaped or offset configuration having one end portion disposed coaxially with the drum axis and the other end offset radially from that axis exteriorly adjacent one end of the drum periphery. Yarn is delivered through the bore of the feeder tube and by imparting relative rotation between the drum and feeder tube, preferably by rotating the tube around the stationary drum, the feeder tube functions similar to the flier in conventional textile winding machines, causing windings of the yarn to be applied in coiled form upon the drum periphery. The drum is supported in cantilevered fashion so that its end opposite the feeder tube is free for withdrawal of the accumulated coils thereover and delivery to any intermittently operating yarn feeding and/or consuming device, which can, for example, take the form of a high speed shuttleless loom. The storage drum is preferably equipped with means for distributing the yarn coils applied thereto by the feeder tube uniformly or evenly axially along its length and to maintain this uniform distribution as lengths of yarn are withdrawn from its free end and fresh coils are applied to its opposite end by the feeder tube. The details of the mechanism for accomplishing the advance of the coils along the drum length are irrelevant here and fully disclosed in the cited Lawson patent and elsewhere.

To insure that the accumulated quantity of yarn on the storage drum is held at a generally constant level and to avoid overloading of the storage device, a detector or monitor is included which is actuated when the accumulated supply of yarn exceeds a predetermined maximum and upon actuation, interrupts the rotation of the flier or drum, as the case may be, to retard the rate of re-accumulation until an operating balance is restored. An insufficiency of yarn in the accumulated supply is avoided, on the other hand, by empirical measures, the rotational output of the motor driving the storage unit being adjusted to generally correspond with the previously determined average rate of consumption of the yarn by the consuming unit, and preferably at a rate slightly in excess of the average rate of consumption so that its basic operating tendency is to provide a slight excess of yarn over the quantity predicted to be needed, the monitoring means functioning to control that excess within tolerable limits.

In general Lawson type feeders are supported with their axes extending horizontally and while the driving force for rotating the feeder tube or drum member might conceivably be supplied by a flexible belt, as in conventional textile winding machines, each individual consuming unit will normally be equipped with its own storage system, and it is thus preferable to drive each storage system by a single electric motor. As is known in the art, the speed regulation of AC electric motors is relatively complex and cumbersome and a DC electric motor is more desirably employed for powering the yarn storage system. As mentioned above, the storage drum must be supported in cantilevered fashion with its supported end coupled to the driving motor. The electric motor is advantageously directly coupled to the rotatable yarn feeder tube and is mounted in coaxial relationship thereto, the yarn feeding tube penetrating centrally through the motor for axial delivery of the yarn and rotating bodily with the motor armature.

Inasmuch as space available at the consuming unit is necessarily at a premium, the axial dimension of the electric motor should be held to a minimum. A DC motor constructed with minimum axial dimension is known in the art, and is generally referred to as a flat armature or "pancake" DC motor. In this type of motor, the armature actually has the form of a thin flat "pancake-like" disc disposed in proximity to one face of an annular stator magnet assembly of only about one inch in axial thickness so that the entire axial dimension of the motor only slightly exceeds one inch. This motor is available in power ratings adequate to drive the yarn storage system in question and provides a desirable combination of characteristics needed for this purpose.

As is explained more fully in the -379 patent, the satisfactory delivery of yarn in the storage feeder system in question presents formidable difficulties in precise working control due to the essentially opposite requirements at the two ends of the system. On the one hand, the consuming unit inherently requires the delivery of yarn thereto on an intermittent or discontinuous basis, lacking any way of accommodating any appreciable excess of yarn over its actual consumption over a given period; on the other hand, the yarn supply source needs to have the yarn removed therefrom on a virtually continuous basis if effective yarn flow is to be maintained. That is to say, the yarn from the supply package must be withdrawn axially or over-end therefrom, since a bodily rotating package would be impossible to control, and over-end withdrawal inherently creates a so-called yarn balloon around the supply package. If the acceleration and deceleration forces inherently imposed upon the yarn by the consuming unit are allowed to migrate along the yarn into the balloon region, the balloon is alternately exposed to forces tending to expand or collapse it, leading to balloon instability and the occurrence of problems created by the inertia of the yarn under conditions of tension instability. Naturally, the yarn once accelerated develops inertia and tends to continue flowing if deceleration is experienced, leading to the sloughing of coils from the package as well as the creation of kinks and tangles which can result in yarn breakage or be carried forward as defects into the fabric or other product being assembled from the yarn. Similarly, if the yarn after deceleration is subjected to acceleration, the inertial resistance produces increased tension and susceptibility to yarn breakage.

In accordance with the improvement of the -379 patent, the output speed of the driving motor, and thus of the storage unit itself, is continuously monitored by a tachometer of the like, preferably in the form of a Hall effect switch sensing the rotational speed of the motor and feed tube by means of magnets equally spaced around the periphery of a rotor rotating bodily with the motor, and the current supplied to the DC motor is controlled so as to vary the actual output motor speed as necessary to correspond with a reference speed preselected, as mentioned above, to slightly exceed the average consumption rate of the yarn consuming unit. A motor speed control device found well suited for this purpose is a silicon controlled rectifier phase control unit, hereinafter referred to as the SCR unit. In order to power the DC motor, as AC line voltage, reduced if need be to an appropriate level, is rectified so as to give a full wave rectified output current consisting of a series of continuous unipolar pulses rising and falling between zero and operative voltage. The SCR unit is synchronized with the flow of pulses in the full wave rectified AC current and is actuated at the same frequency of such pulsed current but with a variable pulse period so that the motor circuit is operatively connected to the motor for only a portion or fraction of the length of each pulse, the extent of the fraction being adjusted by the SCR unit as necessary to supply the motor with an aggregate current sufficient to maintain the preset output speed. Stated in other terms, the SCR unit in effect momentarily disconnects the motor circuit for a complementary fraction of each current pulse so that the net current received by the motor increases or decreases to maintain the preselected actual motor output speed under varying driving conditions. The monitor associated with the storage member to detect the collection thereon of excess yarn above the desired predetermined yarn accumulation level is also connected to the SCR unit so as to superimpose upon the normal cycling action of that unit a further control function which temporarily deactivates the SCR unit to interrupt current flow to the motor as needed to reduce the accumulation of yarn on the storage member until the excess condition has been alleviated.

It has been discovered that the combination of the SCR phase control unit for regulating the actual motor speed with a low inductance DC motor such as the preferred flat armature DC motor results in a substantial reduction in the operating efficiency of the motor, especially in terms of output torque. In interrupting each current pulse for a fraction of its normal period, the effect of the SCR unit is to develop in the motor circuit an electric current characterized by a high RMS current in comparison to average current. As is known, the generation of heat by a motor corresponds with the RMS current it receives, while the development of output torque corresponds to the average motor current. Thus, where the RMS current is high in relation to the average current, the output torque of the motor is relatively low at a given current and an increase in motor current to increase output torque leads inherently to increased heating. By reason of its design, the low inductance armature DC motor is subjected to rather stringent maximum operating temperature which, therefore, limits the maximum current that can be applied to the motor and thus the maximum achievable output torque.

SUMMARY OF THE PRESENT INVENTION

In accordance with the present invention, an electrical choke is incorporated into the motor circuit for a DC pancake motor, the function of the choke being to generate upon the collapse of the normal electrical field therein when the electrical current passing therethrough is interrupted by the SCR control unit, a current passing through the motor in the same direction as the normal current flow therethrough and thereby decrease the RMS current in relation to the average current passing through the motor. At the reduced RMS current level, the tendency of the motor to undergo heating from the current is likewise reduced and an increase in the available output torque of at least 50% can thereby be achieved at the same RMS current levels.

STATEMENT OF OBJECTS

An object of the present invention is, therefore, to provide an improved electrical circuit for a low inductance DC motor such as a flat armature DC electric motor employed in powering a yarn storage feeder system of the type disclosed in U.S. Pat. No. 4,226,379 in order to obtain significantly enhanced operating efficiency, particularly output torque, in such motor.

A further object of the invention is the incorporation of an electrical choke into the electrical circuit of the electrical motor employed in the system in question so as to reduce the ratio of the RMS current to average current in the motor current and thereby reduce the tendency of such motor to heating while increasing its maximum output torque.

BRIEF DESCRIPTION OF THE DRAWINGS

FIG. 1 is a schematic drawing of the electrical circuit employed for energizing the flat armature DC motor which powers the yarn feeder-storage system, incorporating the improvements of the present invention;

FIG. 2 is a sample waveform of a full wave rectified AC electrical current delivered to the electrical motor driving the system in question, showing the effect upon the pulses of such current of the operation of the SCR phase control unit for controlling motor output speed, the solid line portion of the waveform representing the actual current flow to the motor as controlled by the SCR unit, while the dotted line portion represents the fraction of each normal current pulse during which current flow is interrupted by the SCR unit;

FIG. 3 is a waveform illustration similar to FIG. 2 except showing the effect upon the waveform of FIG. 2 of the addition to the motor circuit of the electrical choke, the solid line in this figure representing the actual current flow to the motor as augmented by the output of the choke while the dotted line represents the current flow to the motor in the absence of the choke corresponding to the solid line curve in FIG. 2;

FIG. 4 is a highly schematic diagram of a yarn storage and feeding system embodying the improved electrical circuit of the present invention.

Referring now to FIG. 4 of the drawings which provides an overall schematic view of the system of the invention, the yarn storage member or accumulator is indicated at 11, the yarn being delivered to one end of the accumulator, as at 13, from a yarn supply package or the like (not shown) and withdrawn from the other end, as at 15, for delivery to a yarn consuming unit (also not shown). It will be appreciated that the latter unit could take the form of a separate intermittently operated yarn feeder functioning to withdraw the yarn at appropriate intervals from the accumulator 11 and forward the same to a yarn consuming unit or, alternatively the yarn could be delivered directly to a yarn consuming unit which would incorporate, either directly or indirectly, yarn feeding elements. The yarn accumulator 11 is powered by a low inductance DC motor 17 which can take the form of a DC flat armature or pancake motor and is directly coupled to the yarn accumulator as by means of a drive shaft indicated schematically at 19. As motor 17 is energized, yarn is caused to be wound upon the yarn accumulator in coils.

Figure 5:
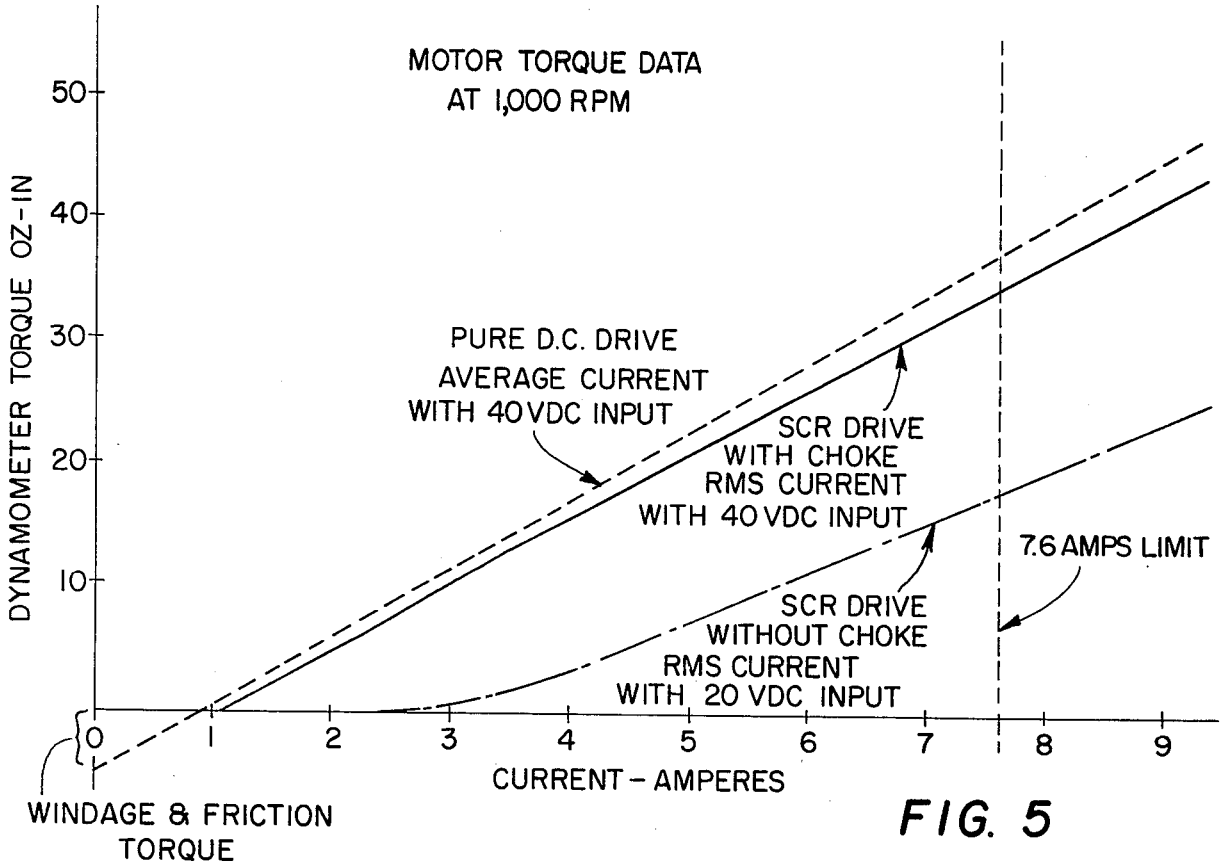
FIGS. 5 and 6 are graphs comparing motor output torques over an effective current range for an identical electrical motor energized by the improved circuit of the invention versus the prior art circuit at 1000 and 3000 rpm motor output speeds, respectively.

The operation of motor 17 is controlled by means of a silicon controlled rectifier phase control unit 21 having its output connected to the motor circuit to control the flow of current to motor 17. The SCR phase control unit 21 is in turn connected as at 23 to a source of full wave rectified AC current maintained at an appropriate voltage level sufficient for the load requirements of the yarn accumulator, for example, +40 volts. the connection being established by way of an electrical choke 25. As is known, choke 25 consists of a coil wound around an iron core.

The output speed of motor 17 is monitored by means of a tachometer 27 or the like and a preferred tachometer consists of a Hall effect switch mounted in proximity to an element, such as a rotor (not shown as such) rotating at the output speed of the motor and carrying around its periphery a plurality of magnets at uniformly spaced intervals. Thus, the tachometer delivers a series of pulses as a digital output signal corresponding to the actual output speed of the motor, and this output signal is applied to one input of a frequency-to-voltage converter 29 for conversion into an analog voltage signal. Also applied to the frequency-to-voltage converter 29 from an adjustable reference speed control 31 is a reference speed voltage signal which is variable over a reasonable range. The converter compares the analog voltage and reference voltage and delivers an output voltage signal of a magnitude corresponding to the difference therebetween, which is proportionate to the deviation of the actual detected motor speed from the desired reference speed, and applies this control signal to the SCR control unit 21.

The reference speed signal of adjustable reference speed control 31 is set by design at a value effective to drive motor 17 at a rate sufficient to deliver to yarn accumulator 11 a quantity of yarn slightly in excess of the average quantity per given unit of time that is withdrawn from accumulator 11 by the consuming unit 15 and hence in time an excess of yarn will develop on accumulator 11. In order to maintain this excess within tolerable limits and prevent its build-up to the point of interfering with further operation, a yarn overfeed detector 33 is associated with the yarn accumulator and is adapted to detect when accumulator 11 contains an excess of yarn above a predetermined maximum and deliver an output indicator signal of the presence of an excess above such maximum. This signal is delivered to an off/on control 35 which is connected to the SCR phase control unit 21 and temporarily deactivates unit 21 for the duration of the yarn overfeed signal. Deactivation of SCR unit 21 interrupts the current flow to motor 17 reducing the rate at which fresh yarn is applied thereto at a level less than that at which the yarn is being removed from the opposite end of accumulator 11 until the detector 33 signals that the excess yarn condition no longer is present.

A more detailed illustration of the motor circuit of the invention appears in FIG. 1 of the drawings wherein elements in common with FIG. 4 will bear the same numerical designation. In the circuit of FIG. 1, the full wave rectified AC current source 23 of say +40 volts is connected to a choke 25 which in turn is connected to one side of a motor 17 which is a low inductance DC motor, preferably a DC flat armature or pancake motor. The other side of motor 17 is connected to the collector of a transistor 41 having its emitter connected to ground as at 43, all of the above connections being in series. The base of transistor 41 is connected to the output of the SCR 45 of the SCR phase control unit 21, the gate of SCR 45 receiving a control signal from phase control unit 21 to fire SCR 45 and apply a voltage to the base of transistor 41. This renders transistor 41 conductive and a current path from voltage source 23 through motor 17 to ground is thereby established. When the gate SCR 45 receives no signal from the phase control unit 21, the base of transistor 41 is nonconductive and consequently the motor control circuit is disconnected and current flow through the motor no longer occurs from source 23.

The SCR control unit 21 is connected to the voltage source 23 so that its output signal is synchronized with the frequency of the basic AC current of that source. As mentioned, current source 23 supplies a full wave rectified AC current in which the bipolar sinusoidal pulses of a normal AC current have been converted into a series of corresponding unipolar pulses changing from zero to +40 volts which is schematically represented by a waveform formed by the combination of the dotted line portions a and solid line curved portion b in FIG. 2. The operative effect of SCR phase control unit 21 operating through SCR 45 is to disconnect the motor circuit during a leading portion, represented by dotted line portion a, of each of the unipolar pulses of the full wave rectified current, and motor 17 receives zero voltage, indicated at c, during the interval. The duration of the period of interruption is indicated at x and is determined by the control signal of the SCR phase control unit which is in turn determined by the input thereto from the frequency-to-voltage converter. When the SCR fires, transistor 41 conducts and the voltage of the waveform rises as at d and remains positive for the remainder of the pulse, indicated at y. Current, therefore, flows through the motor which receives an effective current corresponding to waveform seen in solid lines in FIG. 2. It will be appreciated that the duration of x and consequently y will be determined by the input to the SCR control and will vary as needed to control the speed of motor 17 to maintain a constant output speed. The reference speed from the adjustable reference control 31 is initially selected so that the leading period x has a magnitude other than zero so as to provide a reference point from which adjustments are made according to variations in actual motor output speed under various operating conditions.

The effect of the overfeed detector 33 has been omitted in FIG. 2 but, in essence, detector 33 "overrides" the other input of the phase control unit 21 and deactivates that unit for whatever interval of time is necessary to restore the quantity of yarn on the accumulator within tolerable limits.

As the applied current passes through choke 25 and motor 17 during the interval that transistor 41 is conductive, an electrical field is set up in choke 25 by the flow of current through its windings. When transistor 41 becomes nonconductive, in effect shutting off the flow of applied current through motor 17, the electrical field created by choke 25 collapses and induces a secondary flow of current passing through the motor 17 in the same direction as the normal applied current. In order to complete the circuit path for this secondary current, a line 47 is connected in parallel around both choke 25 and motor 17 which incorporates a so-called freewheeling diode 49 that allows the secondary current to flow through motor 17 in the appropriate direction but prevents the reverse flow of current through line 47 from voltage source 23.

The change in the motor current as a consequence of the incorporation of choke 25 into the circuit is illustrated by the solid line curve of the waveform in FIG. 3. As the applied current flow, represented by the dotted line curve, decreases from the maximum voltage of source 23, the electrical field in choke 25 collapses and produces a secondary voltage which in effect bridges the interruption that appeared in the waveform of FIG. 2 between the trailing and leading edges of successive current pulses. Thus, the solid line waveform of FIG. 3 has a generally saw-toothed configuration characterized by distinctly reduced voltage drops between peak voltage levels compared to the foreshortened normal pulse configuration of the applied current represented by the dotted line waveform in FIG. 3.

Transistor 41 has a characteristic tolerance to reverse bias of, for example, around 100 volts, which if exceed could result in damage to the transistor. In order to protect against such damage due to accidental overloading, improper connection, or line transients, a zener diode 51 is connected in parallel across the collector and emitter of the transistor in a direction opposite to that of the transistor, the zener diode being selected to have a breakdown voltage less than the voltage at which the transistor might become damaged, say about 80 volts.

Figure 6:
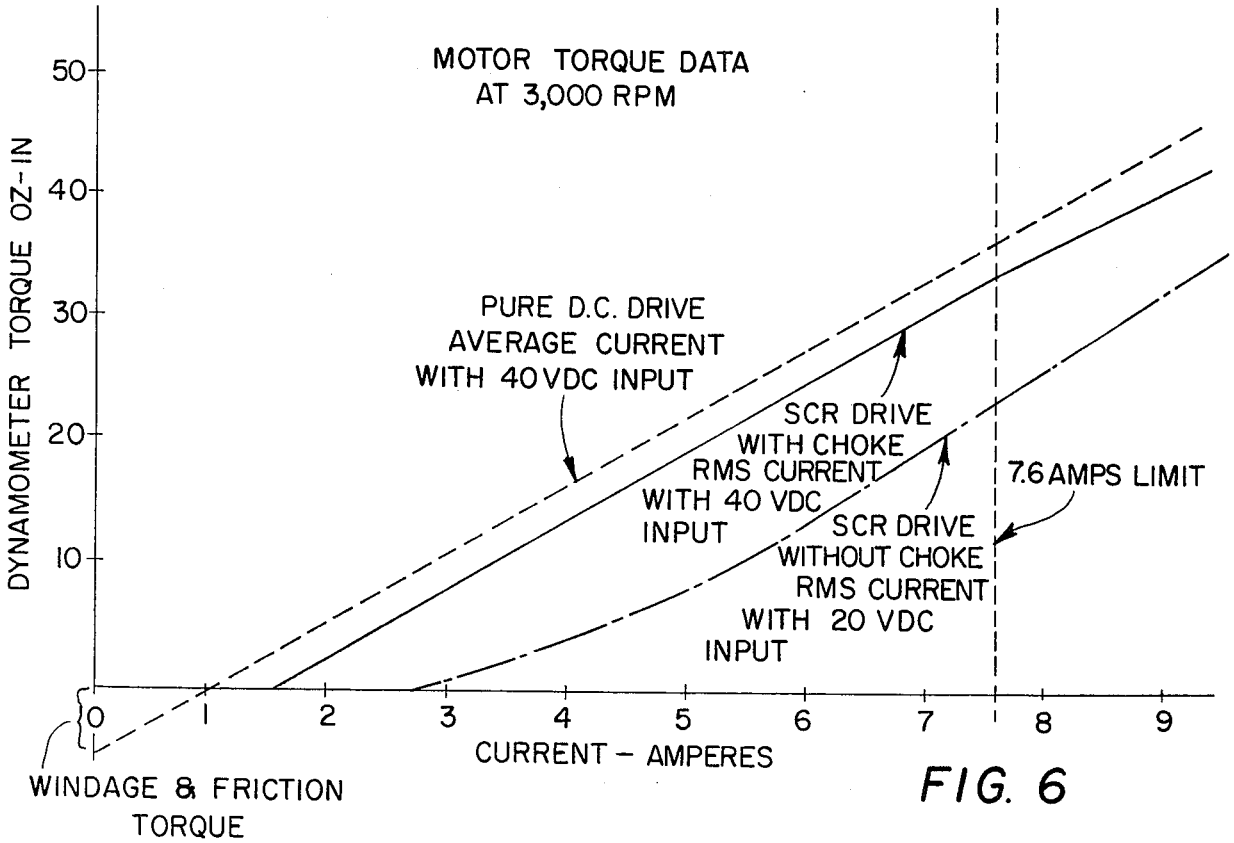

The practical results of the improvement of the present invention are depicted graphically in FIGS. 5 and 6 for two levels of motor output speeds; namely, 1000 and 3000 rpms, for the hereinafter identified preferred motor. Each graph includes separate output torque curves, as determined by dynamometer measurement for the following three motor drive conditions: (1) pure DC drive, i.e., with SCR phase control unit and choke, represented by the broken line; (2) SCR phase control unit drive without choke, represented by a dot-dash line; and (3) SCR phase control unit drive with choke represented by a solid line. FIGS. 5 and 6 also indicate the maximum stall current of 7.6 amp for which the particular motor being tested is rated by the manufacturer without overheating above an armature temperature of 150° C.

It will be observed that in each of FIGS. 5 and 6, the solid line representing the torque output of the motor when driven from the SCR control unit with the choke closely approximates the "ideal" motor output when the motor is driven by pure DC as represented by the broken line. In contrast, the motor torque output when driven by the SCR phase control unit alone is substantially below the output achieved when the choke is incorporated in the motor circuit over the entire effective current range. Therefore, the motor when driven by the circuit of the invention combining the SCR unit and choke generates substantially increased torque at any permissible RMS current level. Based on FIGS. 5 and 6, in general the improvement of the invention roughly doubles the maximum available output torque of the motor when operating at 1000 rpm and achieves a 50% increase in that torque when operating at 3000 rpm.

As regards the change in the ratio of RMS current to average current that results from the present improvement, the form factor of the waveform of the current delivered to the motor by the circuit of the invention, corresponding generally to that depicted in FIG. 3, is in the range of 1.04–1.37 compared to the range of 1.35–2.55 for the unmodified motor circuit.

The electrical components employed in the invention are, of course, conventional in themselves and can be readily selected by the skilled worker in the art to satisfy the needs of a particular installation. However, as an illustration, utilizing a 40 volt full wave rectified current source, a choke having an impedance of 10 mH has been found to be imminently satisfactory in association with the preferred flat armature motor as hereinafter more specifically described. The selection of the remaining electrical components will be obvious. As regards the control instrumentalities incorporated into the circuit, the following commercially available units have been employed with good results and are preferred in the light of this experience:

| | |
|---|---|
| Motor 17 | Model 12FP manufactured by Printed Motor Division Kollmorgen Corporation Glen Cove, New York |
| Hall Effect Detector 27 | Model UGN-3020T manufactured by Sprague Electric Company Concord, New Hampshire |
| Frequency-to-Voltage Converter Integrated Circuit 29 | Part No. RC4151NB manufactured by Raytheon, Semi-Conductor Division Mountain View, California |
| SCR Motor Speed Control Integrated Circuit 21 | Model No. L120B1 manufactured by SGS - Ates Semiconductor Corporation Newtonville, Massachusetts |

The disclosure of U.S. Pat. No. 4,226,379 is also incorporated herein by reference.

It will be understood that modifications and variations within the concept described above are possible and will be readily suggested to the skilled worker in the field and such modifications and variations are intended to be within the scope of the invention except when excluded by the limitations of the following claims.

What is claimed is:

1. A yarn feeding system comprising a yarn source, yarn accumulating means operable to remove from said supply and accumulate a generally predetermined amount of yarn, intermittently active yarn withdrawing means for periodically from said accumulating means removing a length of yarn less than the predetermined amount accumulated thereon, operating means for said accumulating means to operate the same to reaccumulate yarn to replace the withdrawn length and maintain in said accumulating means said predetermined quantity and being responsive to said detecting means to temporarily interrupt said accumulation, said operating means including a low inductance DC motor for driving said yarn accumulating means and an electric circuit for supplying current to said motor which comprises a source of a full wave rectified AC current connected to said motor, comparing means for comparing the actual output speed of said motor with a predetermined reference motor speed and producing an output signal when the actual motor speed deviates from said reference speed, an SCR control unit activated by the output signal from said comparator to control the passage of said rectified current through said circuit to said motor to maintain the actual motor speed for driving said accumulating means at said reference speed, and electrical choke means connected in series with said motor and current source to increase the available torque delivered by said motor at a given current level controlled by said SCR unit.

2. The system of claim 1 wherein said motor is a flat armature DC motor.

3. The system of claim 1 wherein a transistor is connected in series with said motor and choke means and said SCR control unit controls the current flow through said transistor.

4. The system of claim 3 wherein said SCR unit is connected to the base of said transistor to control the flow of current therethrough.

5. The system of claim 1 including a zener diode connected across the collector and emitter of said transistor, and preventing back-biasing of said transistor at a voltage which would damage the transistor.

6. The system as in claim 1 wherein the full wave rectified current comprises a series of unipolar pulses of a given normal duration equal to twice the frequency of said AC current and said SCR unit includes phase control means for operatively connecting said rectified current source into said circuit for a fraction of the normal duration of each of the pulses thereof, the extent of said fraction being adjusted by the signal from said comparing means to bring said motor speed into correspondence with said reference speed.

7. The system of claim 6 including a line connected to said motor circuit in parallel across said choke means and motor to conduct current flow to said motor from said choke means during the period of each pulse when said current source is disconnected from said circuit and comprising a diode in said line for preventing reverse current flow via said line to said motor.

8. The system of claim 1 including detecting means for detecting the accumulation by said accumulating of yarn in excess of said predetermined amount and applying an output signal to said SCR control unit to deactivate the same until said excess accumulation is dissipated by the withdrawal of yarn therefrom.

9. The system of claim 1 including means for adjusting said reference motor speed to a level sufficient to accumulate yarn on said accumulating means at a rate substantially equal to the average rate of withdrawal of the yarn therefrom.

* * * * *